US005203674A

United States Patent [19]

Vinciguerra

[11] Patent Number: 5,203,674

[45] Date of Patent: Apr. 20, 1993

[54] COMPACT DIFFUSER, PARTICULARLY SUITABLE FOR HIGH-POWER GAS TURBINES

[75] Inventor: Costantino Vinciguerra, Florence, Italy

[73] Assignee: Nuovo Pignone S.p.A., Florence, Italy

[21] Appl. No.: 795,789

[22] Filed: Nov. 21, 1991

Related U.S. Application Data

[63] Continuation of Ser. No. 602,797, Oct. 24, 1990, abandoned, which is a continuation of Ser. No. 818,250, Jan. 13, 1986, abandoned, which is a continuation-in-part of Ser. No. 551,005, Nov. 14, 1983, abandoned.

[30] Foreign Application Priority Data

Nov. 23, 1982 [IT] Italy ..... 24370 A/82

[51] Int. Cl.[5] ..... F01D 1/02

[52] U.S. Cl. ..... 415/211.2; 415/208.1

[58] Field of Search ..... 415/208.1, 208.2, 211.1, 415/211.2

[56] References Cited

U.S. PATENT DOCUMENTS 2,840,342 6/1958 Silvern .

FOREIGN PATENT DOCUMENTS

| | | | |
|---|---|---|---|
| 834474 | 4/1952 | Fed. Rep. of Germany . | |
| 2925941 | 2/1980 | Fed. Rep. of Germany . | |
| 3214101 | 1/1984 | Fed. Rep. of Germany . | |
| 501182 | 4/1920 | France | 416/223 B |
| 2001948 | 2/1969 | France . | |
| 2401311 | 4/1979 | France . | |
| 587509 | 4/1947 | United Kingdom . | |
| 624273 | 6/1949 | United Kingdom . | |
| 813247 | 5/1959 | United Kingdom . | |
| 1136851 | 12/1968 | United Kingdom . | |
| 1240568 | 7/1971 | United Kingdom . | |
| 2074244 | 10/1981 | United Kingdom . | |

*Primary Examiner*—John T. Kwon

*Attorney, Agent, or Firm*—Hedman, Gibson & Costigan

[57] ABSTRACT

A compact diffuser for high-power gas turbines, comprising a first diffusion section of substantially axial path defined by two conical coaxial walls, followed by a double curved diffuser with three walls, of which the intermediate wall is cantilever-supported by a set of aerodynamically profiled ribs disposed horizontally and situated near the exit of said double curved diffuser. The diffuser is connected to the turbine exhaust casing by an envelope internal to said exhaust casing and having its contours smoothly joined to the diffuser.

6 Claims, 3 Drawing Sheets

COMPACT DIFFUSER, PARTICULARLY SUITABLE FOR HIGH-POWER GAS TURBINES

This is a continuation application of Ser. No. 07/602,797, filed Oct. 24, 1990, which is a continuation application of Ser. No. 06/818,250, filed Jan. 13, 1986, now abandoned, which is a continuation-in-part application of Ser. No. 06/551,005, filed Nov. 14, 1983, now abandoned.

FIELD OF THE INVENTION

This invention relates to improvements in a diffuser particularly suitable for high-power gas turbines (exceeding 10,000 kW) which enables very high diffusion efficiencies to be obtained for small overall axial and radial dimensions, which do not exceed those allowable in current designs which are dictated by transportation considerations. Because of the high diffusion efficiency obtainable and the consequent lower exhaust gas velocity, a considerable reduction in vibration and noise is also attained, thus making the construction of the exhaust silencer easier, with consequent reduced costs and bulk.

BACKGROUND OF THE INVENTION

The diffusers most frequently used in power gas turbines are known to be derived from those designed and arranged for aeronautical turbines in which a small overall radial dimension is essential, and in which the diffusion duct must be traversed by aerodynamically profiled double-wall ribs, which are cooled in the interspace with cold gas for supporting the shaft bearing which would otherwise not be reachable.

These diffusers are compromised of two coaxial conical walls with an angle of about 7° between the cones. In this respect, a diffuser of this type has its maximum efficiency under conditions of best compromise between the friction loss at the two walls, which is dependent on length for equal surface finishes and is thus smaller the shorter the diffuser, and the diffusion turbulence losses which are smaller the more gradual the diffusion and thus the longer the diffuser. It has been found experimentally that the optimum compromise length, dependent on degree of finish, velocity etc., corresponds as a first approximation to an angle between the cones of about 7° for two-wall diffusers of prevalently axial extension.

On the other hand, the gas is still at high velocity when leaving the diffuser, and its energy is therefore lost, but as the exhaust is axial and taking into account the aeronautical compromise between weight, overall size and efficiency, this loss is accepted.

Land-based turbines, which derive from aeronautical experience, use similar diffusers, the only difference being that at the end of the diffuser the gas is made to curve into the radial direction due to the fact that the exhaust is radial in land-based turbines. In order to curve the gas with smaller losses and smaller radii, formations of deflectors are often arranged in the bend, and have a cross-section in the form of parallel circular arcs. Gas diffusion is considered finished at the end of the conical portion, and the deflectors serve only to reduce the pressure drop through the bend, and not for diffusion purposes.

Land-based turbines derived from aeronautical technology do not exploit the larger range of alternatives offered by land installations over aeronautical installations for the following reasons:

a) they retain the bearing support ribs at the diffuser inlet where the gas is of considerable velocity, resulting in a certain loss which becomes much greater if the turbine has to operate under other than design conditions. In such a case the loss caused by the reduction in cross-section during passage through the ribs is supplemented by the loss caused by the impact of the gas against the ribs, this impact occurring at an angle of incidence which is more removed from the optimum angle the more the operation deviates from the design point (in the case of land-based turbines, it is not unusual to have to operate at 50% of the initial design speed). In the aeronautical turbine, the ribs are essential for overall size and weight reasons. In the land-based turbines, the bearing could instead be supported from the outside if certain mechanical problems related to the shaft line are solved; and b) they do not reduce the exhaust gas velocity to a minimum without negative effects in the efficiency and noise level.

One type of diffuser which is beginning to be adopted in land-based turbines is precisely characterized by the elimination of these ribs and an attempt to improve diffusion in the final bend. The ribs are eliminated by supporting the bearing from the outside, given that the exhaust is no longer axial, and the bend is made in the form of a truly curved diffuser which is much more complicated than a straight diffuser but which by careful design and experimental setting-up can attain a further worthwhile recovery.

In order to further improve this type of diffuser, it is necessary either to increase the axial conical portion so as to arrive at the bend with a greater diffusion ratio, which however causes an intolerable increase in the axial turbine length, or to dispose an intermediate wall in said portion so as to double the diffusion angle. This path has been followed in particular by those manufacturers who retain the bearing support ribs so as to also support the intermediate wall by these latter. However, this design gives only insignificant results for obvious reasons. In this respect, by retaining the ribs, all the aforesaid losses under working conditions other than the design condition still occur, and in addition because of the said balance between friction losses and diffusion losses, the introduction of the double wall into the zone in which the gas is still at high speed leads to an increase in losses due to friction and entry impact, which strongly reduce the theoretical advantages of the increased diffusion.

A second path would be to increase the curved diffuser portion, but this would lead to an increased overall radial dimension which in the case of large turbines is even less desirable (transport problems etc.).

OBJECT AND SUMMARY OF THE PRESENT INVENTION

The object of the present invention is to obviate these size problems, and to obtain considerably improved diffusion and thus increased turbine efficiency, with decreased exhaust noise. This is substantially attained by a diffuser comprising a first diffusion portion having two prevalently conical walls and extending in a direction which forms a certain angle with the axis so as to better present itself to the bend.

This first diffuser portion, which is free from ribs and intermediate walls and operates under optimum conditions, forms the most important part of the diffusion process, and is followed by a second double curved diffuser portion comprising three walls, which allows optimum final diffusion in the bend and within the available overall dimensions.

The intermediate wall which enables the second double diffusion portion to be formed is cantilever-supported by a twin set of aerodynamically profiled ribs, hereinafter termed airfoil ribs, disposed at the final part of the second diffusion portion where the gas has almost completely diffused to a velocity which is so low as not to create appreciable losses.

This arrangement, which enables the initial part of the intermediate wall to be cantilever-supported, is made possible by the rigidity which the intermediate wall possesses by virtue of its curvature. The initial part or leading edge of the intermediate wall is machined so as to provide it with an aerodynamic profile suitable for dividing the stream which arrives from the initial diffusion stage into two streams without any impacts or sudden cross-section reductions being undergone, and in addition that part which has the largest extent of cantilever is thinned down to a profile which is almost optimum in eliminating the vibration modes at the various frequencies encountered under the different running conditions.

The twin set of airfoil ribs in the present invention provides such a rigid connection for the intermediate wall in the second diffuser portion that a very large portion of the intermediate wall, approximating a length of 3.0 times the width of one conduit of the double curved diffuser, can be extended in a cantilever fashion along the flow direction.

The efficiency, losses due to impacts and friction are very large at high gas velocities (they increase with a square relationship) and this has dictated the elimination of the ribs and the choice of a diffuser comprising only two walls in the first diffusion portion. In the curved portion of the diffuser, however, the sufficiently decelerated gas has a greater need for guidance (diffusion through a bend is extremely more complicated). For this reason, the use of the ribless cantilever-supported intermediate wall in the initial section of the second diffuser portion allows operation as two parallel curved diffusers with nearly double angles of diffusion. This enables the gas to enter the exhaust chamber at a velocity almost one half that obtainable with a final conventional curved diffuser.

The airfoil ribs which support the intermediate wall are also designed and angularly disposed in such a manner as to also perform an aerodynamically advantageous function. In this respect, by creating a controlled final cross-section reduction at the outlet from the second double curved diffusion portion, (when the gas has almost completed its expansion), the uniformity of its circumferential outlet velocity is decisively improved.

Since the pressure drops and noise problems associated with diffuser outlet velocities are increased as a function of the square power of the velocity, it is apparent that the present invention's achievement of a virtually uniform outlet radial velocity, is highly beneficial from a noise abatement and pressure loss standpoint.

This is because by causing a cross-section reduction at the outlet of the second double curved portion of the diffuser, the ribs cause the gas to distribute uniformly along the outlet circumference by masking the sucking action of the radial exhaust mouth, this action being non-symmetrical about the axis. The gas leaves almost perfectly distributed circumferentially, and by providing a suitably shaped duct inside the exhaust chamber which conveys it in an ordered manner towards the outlet, it reaches the final silencer at a very low velocity, which practically no pressure pulsation, and thus with minimum aerodynamic noise.

This explains the apparently contradictory fact that an increase in efficiency can be obtained by introducing the ribs (ie obstacles).

This final outlet arrangement is important, because in many diffusers a large fraction of the pressure recovery which has been attained in the diffuser is destroyed in the exhaust chamber in the form of a pressure drop. The effect is therefore an increase in turbine efficiency and a considerable reduction in the noise level of the exhaust gas which is known to represent one of the drawbacks most difficult to eliminate in land-based applications (large, costly silencers of short life given that the operating temperature exceeds 450° C.).

Experimental tests have fully confirmed this phenomenon, and in fact the final noise reduction is an indirect and immediate measure of the improved efficiency as the various parameters i.e., number of ribs, initial profile, difference in curvatures and ratios, vary.

Again experimentally, it has been shown that within the overall allowable dimensions, the concept of multiplying the walls in the curved diffusion portion cannot be further extended because if a second intermediate wall is provided, the consequent friction losses balance-out the improvements. If more are added, the efficiency begins to worsen.

It has been determined that the applicants' improved compact diffuser when applied to high power gas turbines results in efficiencies of 0.7 compared to hereto known large power turbine efficiencies of 0.5.

In addition, the present invention reduces both the noise and vibration levels of high power turbines.

DETAILED DESCRIPTION OF THE PRESENT INVENTION

The invention is described in detail hereinafter with reference to the accompanying drawings, which illustrate a preferred practical embodiment by way of non-limiting example only, in that technical and constructional modifications can be made thereto without leaving the scope of the present invention, wherein.

Figure 1:
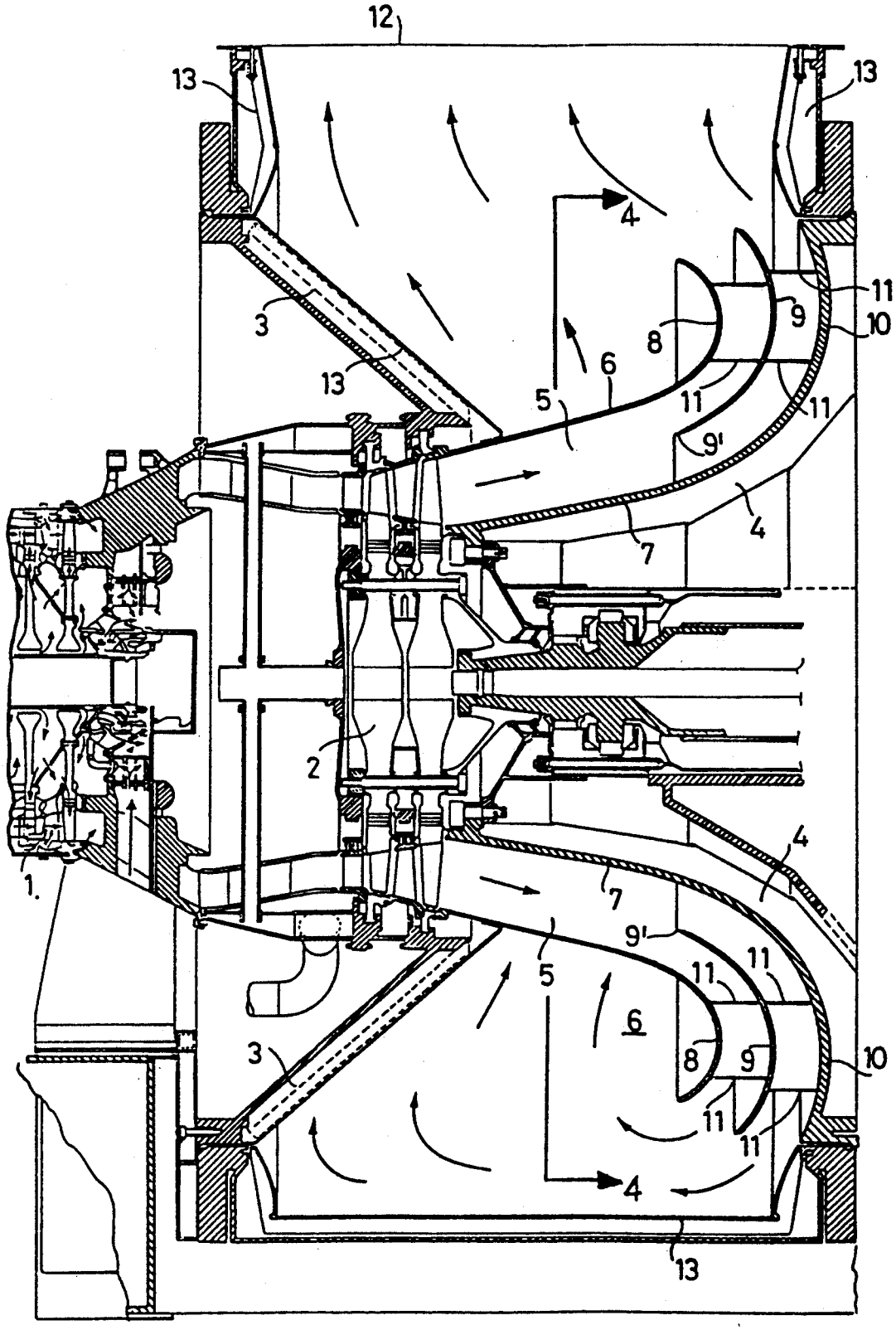
FIG. 1 is a partial longitudinal section through a power gas turbine using the diffuser according to the invention.

In the figures, the reference numeral 1 indicates the gas generator for the gas turbine, which feeds the power turbine 2, of which the exhaust gas is conveyed into the exhaust casing 3 through the diffuser 4.

The diffuser 4 comprises a first diffuser portion 5 of substantially axial extension defined by two prevalently conical coaxial walls 6 and 7.

Figure 2:
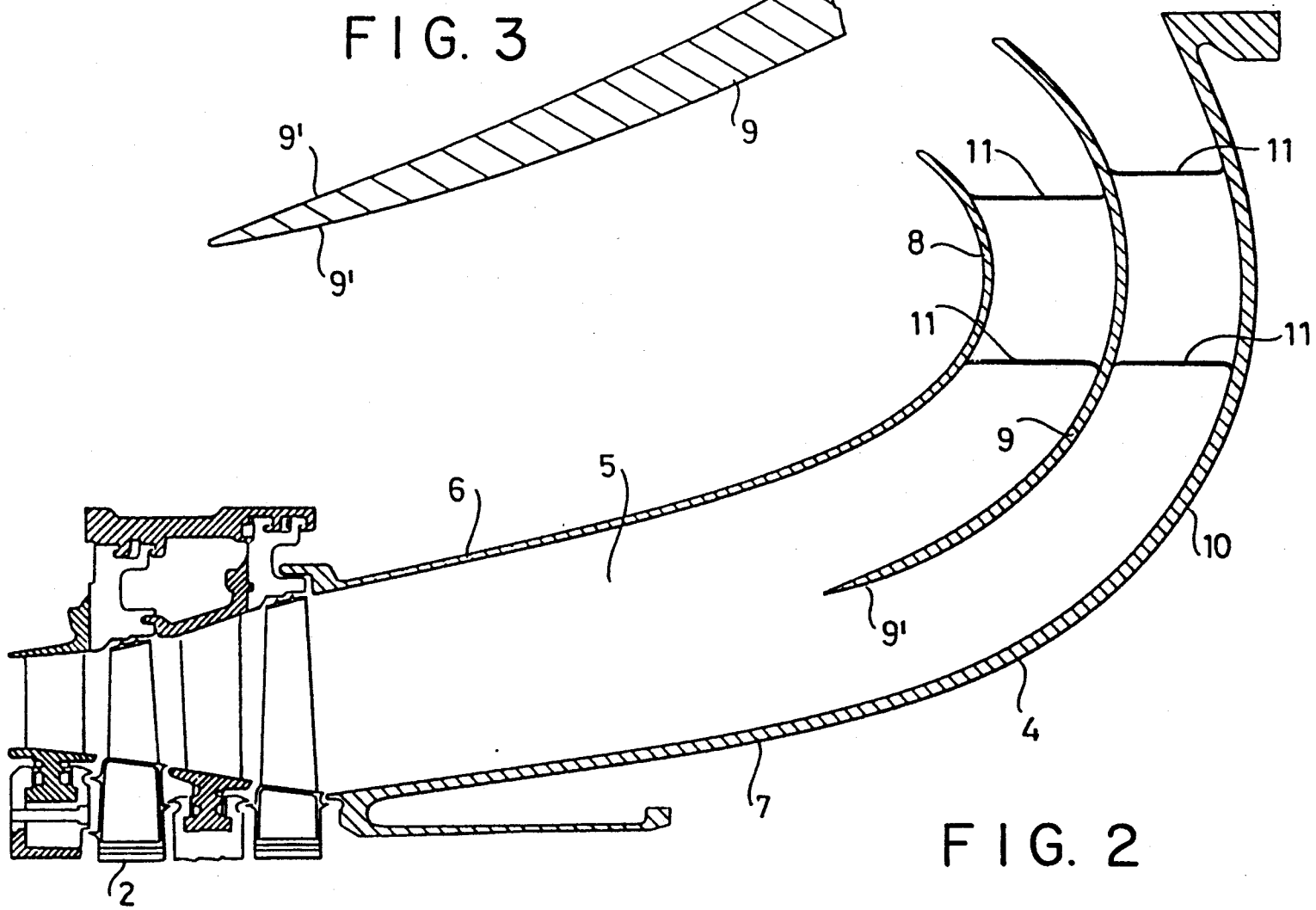
FIG. 2 is a partial longitudinal section through the diffuser of FIG. 1 to a larger scale.

The first portion 5, which is inclined at a certain angle (see FIG. 2) to the horizontal in order to better present the gas stream to the bend, performs the most important part of the diffusion, and achieves it in an optimum manner as there are no ribs or intermediate walls.

The first diffuser portion 5 is followed by a second double curved diffuser portion comprising three walls 8, 9 and 10, which completes the diffusion of the gas, now separated into two independent streams, and at the same time causes it to curve radially.

The intermediate curved wall 9 which enables the second double curved diffuser to be formed is cantilever-supported by a twin set of airfoil ribs 11 which have their generating lines parallel to the horizontal axis of the power turbine, and are arranged almost at the end of the second double curved diffuser. The ribs 11 are dimensioned in such a manner as to create in the second double curved diffuser a controlled cross-section reduction at the outlet from the curved portions. This results in a uniform circumferential distribution of the outlet velocity of the gas as it enters the exhaust casing 3, and thus substantially attenuates the non-symmetrical sucking action on the gas at the exhaust mouth 12 of the casing 3 (see specifically FIG. 4). In order not to disturb the uniformity of the circumferential outflow of the gas from the diffuser and thus favor ordered gas flow towards the exhaust mouth 12, the diffuser 4 is connected to the exhaust casing 3 by an envelope 13 which has it contours smoothly joined to the diffuser and is contained in the exhaust casing itself.

Figure 3:
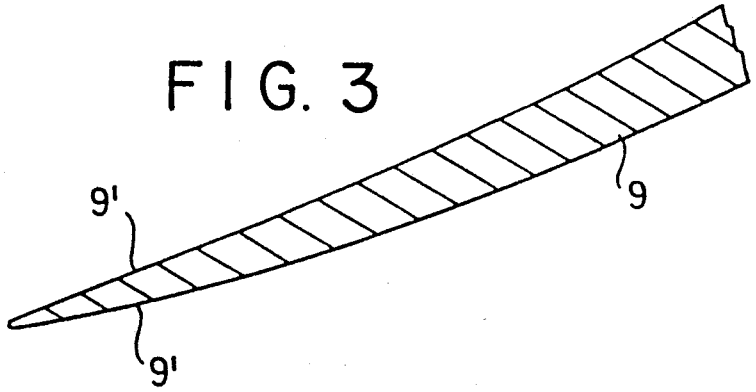
FIG. 3 is a partial longitudinal section through a detail of the diffuser according to the invention, to a much larger scale.

Referring again to FIGS. 2 and 3, the intermediate curved wall 9 commences with a portion 9' which is aerodynamically machined and profiled in such a manner as to divide the gas stream, which arrives from the first portion of the diffuser at an already reduced velocity, into two streams without undergoing impact or sudden variations in cross-section.

Figure 4:
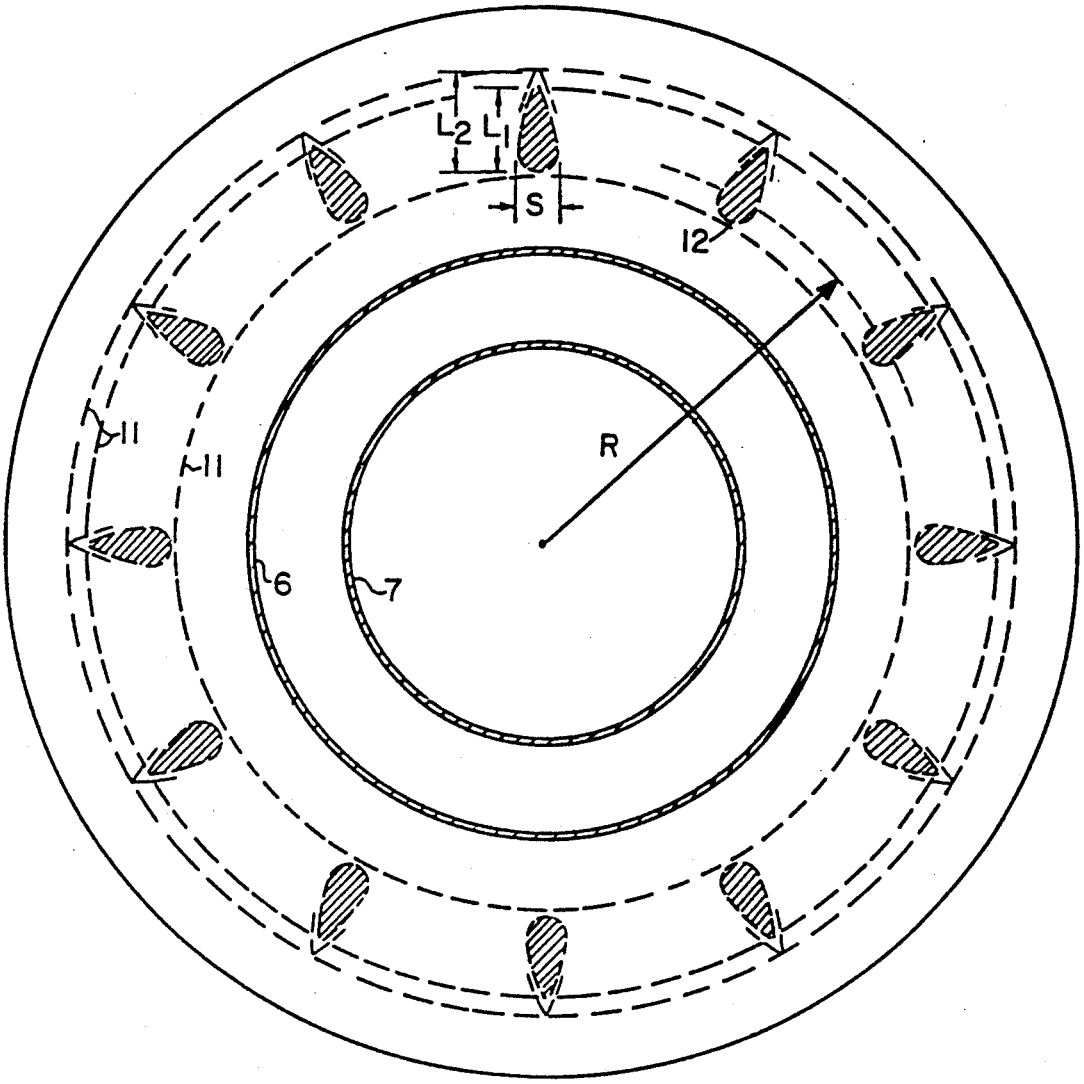
FIG. 4 is a cross-sectional view of the diffuser taken along the line 4—4 of FIG. 1 showing a preferred embodiment of the double curved diffuser section according to the present invention.

As shown in FIG. 4, the intermediate curved wall 9 is supported by the airfoil ribs 11 of the present invention which are uniformally spaced about the circumference of the second double curved diffuser. As seen the airfoil ribs 11 have a substantial thickness, indicated by the letter "S", in the circumferential direction, and lengths $L_1$ or $L_2$ corresponding to the inner and outer conduits of the second double curved diffuser, respectively. The number of airfoil ribs varies according to size of the diffuser section but is typically from about 8 to 16 and preferably about 12.

The diffusion outlet cross-section is thereby reduced by the number of airfoil ribs according to the formula $2\pi R$-ns, where R is the radius from the turbine axis to the widest point of the airfoil ribs and "n" is the number of ribs provided in the diffuser.

As shown in section, the airfoil ribs 11 generally have a teardrop shape. Typically, the base 12, or leading edge of the ribs is semi-circular in shape. The sides of the base are extended upwardly and inwardly to form an apex at the trailing edge of the rib 11.

The aerodynamic outline of the invention does not create flow disturbences while substantially improving the circumferential distribution of the gaseous stream. The result is improved diffuser efficiency, lower pressure drop and improved noise abatement.

I claim:

1. A compact diffuser for high-power gas turbines, comprising a first diffusion section free of ribs and/or intermediate walls, wherein said first diffusion section is of substantially axial path, and is defined by two prevalently conical coaxial walls inclined at an angle to the horizontal axis of the turbines, and a double curved diffuser section with three walls following said first diffusion section, wherein the intermediate curved wall of said double curved diffuser section immediately follows said first diffuser section and is cantilever-supported by a twin set of airfoil shaped ribs, said ribs being linear along their length and uniformly spaced about the circumference of the double curved diffuser section, having their generating lines parallel to the horizontal axis of the turbine and are situated near the end of said double curved diffuser to provide substantially uniform outlet velocity from the diffuser.

2. A diffuser as claimed in claim 1, wherein said intermediate curved wall of said double curved diffuser commences with an end which is aerodynamically machined and profiled in such a manner as to divide the stream without said wall undergoing impact or sudden variations in cross-section.

3. A diffuser as claimed in claim 1, wherein said ribs are aerodynamically profiled and dimensioned in such a manner as to create a reduction in cross-section near the outlet of said double curved diffuser section of said diffuser.

4. A diffuser as claimed in claim 1 being further connected to the turbine exhaust casing by means of an envelope which has its contours smoothly joined to the diffuser and is contained in the exhaust casing itself.

5. A diffuser as claimed in claim 1, wherein each set of airfoil shaped ribs comprises about 8 to 16 ribs.

6. A diffuser as claimed in claim 1 wherein said intermediate wall extends a cantilever length from said airfoil shaped ribs of about three times the width of one conduit of said double curved diffuser.

* * * * *